US011143060B2

(12) United States Patent
Yamane et al.

(10) Patent No.: US 11,143,060 B2
(45) Date of Patent: Oct. 12, 2021

(54) ROCKER ARM AND METHOD OF MANUFACTURING THE SAME

(71) Applicant: OTICS CORPORATION, Nishio (JP)

(72) Inventors: Naoyuki Yamane, Nishio (JP); Kiyoshi Masegi, Nishio (JP); Kimihiko Todo, Nishio (JP)

(73) Assignee: OTICS CORPORATION, Nishio (JP)

( * ) Notice: Subject to any disclaimer, the term of this patent is extended or adjusted under 35 U.S.C. 154(b) by 366 days.

(21) Appl. No.: 15/453,181

(22) Filed: Mar. 8, 2017

(65) Prior Publication Data

US 2017/0284232 A1 Oct. 5, 2017

(30) Foreign Application Priority Data

Mar. 29, 2016 (JP) ..... JP2016-064793

(51) Int. Cl.

| | |
|---|---|
| ***F01L 1/18*** | (2006.01) |
| ***B21D 53/84*** | (2006.01) |
| ***F01L 1/053*** | (2006.01) |
| ***F01L 1/20*** | (2006.01) |

(52) U.S. Cl.

CPC ..... *F01L 1/185* (2013.01); *B21D 53/84* (2013.01); *F01L 1/053* (2013.01); *F01L 1/181* (2013.01); *F01L 1/20* (2013.01); *F01L 2303/00* (2020.05)

(58) Field of Classification Search

CPC ... F01L 1/181; F01L 1/20; F01L 1/053; F01L 2103/00; F01L 1/185; F01L 2105/02; F01L 2305/00; F01L 1/18; F01L 1/182; B21D 53/84; B21K 1/205

USPC ..... 123/90.39, 90.44, 90.41

See application file for complete search history.

(56) References Cited

U.S. PATENT DOCUMENTS

| | | | | |
|---|---|---|---|---|
| 4,727,832 A * | 3/1988 | Miyamura | ..... | F01L 1/181 123/90.39 |
| 4,829,647 A * | 5/1989 | Anderson | ..... | B21D 53/88 123/90.39 |
| 4,872,429 A * | 10/1989 | Anderson | ..... | B21D 53/88 123/90.44 |
| 6,978,750 B2 * | 12/2005 | Yamazaki | ..... | F01L 1/18 123/90.39 |
| 7,062,852 B2 * | 6/2006 | Shimizuya | ..... | B21D 53/84 123/90.39 |

(Continued)

FOREIGN PATENT DOCUMENTS

| | | |
|---|---|---|
| DE | 10 2004 012 142 A1 | 9/2005 |
| DE | 10 2006 048 342 A1 | 4/2008 |

(Continued)

OTHER PUBLICATIONS

English language machine translation of WO-2015018400.*

(Continued)

*Primary Examiner* — Patrick Hamo
*Assistant Examiner* — Wesley G Harris
(74) *Attorney, Agent, or Firm* — Smith, Gambrell & Russell, LLP

(57) ABSTRACT

A rocker arm includes a pair of sidewalls disposed along a heightwise direction so as to be opposed to each other. The sidewalls define a space to house a roller and have opposed portions extending in the heightwise direction relative to adjacent portions which are adjacent to the opposed portions. The opposed portions have thinner portions having smaller thicknesses than the adjacent portions.

10 Claims, 10 Drawing Sheets

(56) References Cited

U.S. PATENT DOCUMENTS

| | | | | |
|---|---|---|---|---|
| 7,222,599 | B2 * | 5/2007 | Waseda | B21K 1/205 123/90.39 |
| 7,444,972 | B2 | 11/2008 | Faria et al. | |
| 8,025,038 | B2 | 9/2011 | Engelhardt et al. | |
| 8,925,505 | B2 | 1/2015 | Moeck et al. | |
| 2004/0255717 | A1 * | 12/2004 | Shimizuya | F01L 1/185 74/569 |
| 2007/0151533 | A1 | 7/2007 | Faria et al. | |
| 2010/0064999 | A1 | 3/2010 | Engelhardt et al. | |
| 2012/0260875 | A1 | 10/2012 | Moeck et al. | |

FOREIGN PATENT DOCUMENTS

| | | | | |
|---|---|---|---|---|
| DE | 10 2011 007 450 | A1 | 10/2012 | |
| DE | 10 2013 214 360 | A1 | 1/2015 | |
| EP | 1547704 | A1 * | 6/2005 | B21D 19/08 |
| JP | 2004-108208 | A | 4/2004 | |
| JP | 2005-105864 | A | 4/2005 | |
| JP | 2005-188362 | A | 7/2005 | |
| JP | 2011-196240 | A | 10/2011 | |
| WO | 03/044331 | A1 | 5/2003 | |
| WO | WO-2015018400 | A1 * | 2/2015 | F01L 1/143 |

OTHER PUBLICATIONS

Japanese Office Action for Application No. 2016-064793 dated Aug. 1, 2019 (3 pages in Japanese with English Translation).

German Office Action dated Sep. 16, 2020 for German Patent Application No. 10 2017 002 516.9. (6 pages).

* cited by examiner

ROCKER ARM AND METHOD OF MANUFACTURING THE SAME

CROSS-REFERENCE TO RELATED APPLICATIONS

This application is based upon and claims the benefit of priority from the prior Japanese Patent Application No. 2016-64793 filed on Mar. 29, 2016, the entire contents of which are incorporated herein by reference.

BACKGROUND

1. Technical Field

The present invention relates to a rocker arm and a method of manufacturing the rocker arm.

2. Related Art

Japanese Patent Application Publication No. JP-A-2011-196240 discloses a rocker arm including an arm body formed by pressing a metal plate. The arm body has an engagement portion which a rocking fulcrum member slidably engages, a sliding portion on which an end of a valve stem is slid, and a pair of sidewalls opposed to each other between the engagement portion and the sliding portion. A hollow potion is defined between both sidewalls, and a roller which is brought into contact with a cam is rotatably housed in the hollow portion. The sidewalls have respective shaft holes into which a rotating shaft of the roller is to be mounted.

In the meantime, a modification in a vehicle or the like increases load input from a cam to the rocker arm. In this case, the rocker arm sometimes requires a large load resistant performance. In order that this problem may be coped with, for example, a thickness of the arm body may be increased so that the rigidity of the rocker arm can be improved. However, since the increase in the thickness of the arm body results in an increase in inertial mass, there is a concern that the responsiveness during rocking would be reduced. Furthermore, a biasing force of a valve spring needs to be increased, and thus, the increase in the thickness of the arm body has a large influence on the design of the entire valve gear.

SUMMARY

The present invention was made in view of the foregoing circumstances and an object thereof is to provide a rocker arm which can ensure sufficient rigidity against input load and which can reduce the inertial mass.

In one aspect, the present invention provides a rocker arm including a pair of sidewalls disposed along a heightwise direction so as to be opposed to each other. The sidewalls define a space to house a roller and have opposed portions extending in the heightwise direction relative to adjacent portions which are adjacent to the opposed portions. The opposed portions have thinner portions having smaller thicknesses than the adjacent portions.

According to the above-described rocker arm, since the thinner portions are rendered thinner, an inertial mass of the rocker arm can be reduced accordingly. In particular, since the opposed portions largely extending in the heightwise direction, the thinner portions can easily be formed utilizing the height of the opposed portions. Furthermore, since the adjacent portions of the sidewalls which are adjacent to opposed portions can be formed with the usual thicknesses, the rocker arm can ensure rigidity sufficient to withstand input load.

In another aspect, the invention provides a method of manufacturing a rocker arm, which includes stamping a plate material to form a developed body having a through hole, applying pressure to parts of the developed body located at both sides of the through hole to stretch the parts of the developed body, thereby forming thinner portions, and folding the developed body via a pair of folding portions parallel to each other thereby to raise portions with the thinner portions in a heightwise direction, so that a pair of sidewalls are formed which are opposed to each other with a space for housing a roller being interposed therebetween.

According to the above-described method, the above-described rocker arm can easily be manufactured by pressing. Particularly in the step of forming the thinner portions, pressure is applied to the parts of the developed body located at both sides of the through hole so that the parts are stretched. This can render the surface area of the developed body at the time of stamping the plate material smaller by an amount of stretch. Consequently, the yield of the plate material can be improved.

DETAILED DESCRIPTION

A first embodiment will be described with reference to FIGS. 1 to 7. A rocker arm 10 of the first embodiment is mounted in a valve gear of a reciprocating engine mounted in an automotive vehicle and rockably supported on a supporting member 96 mounted to a cylinder head 91.

Figure 6:
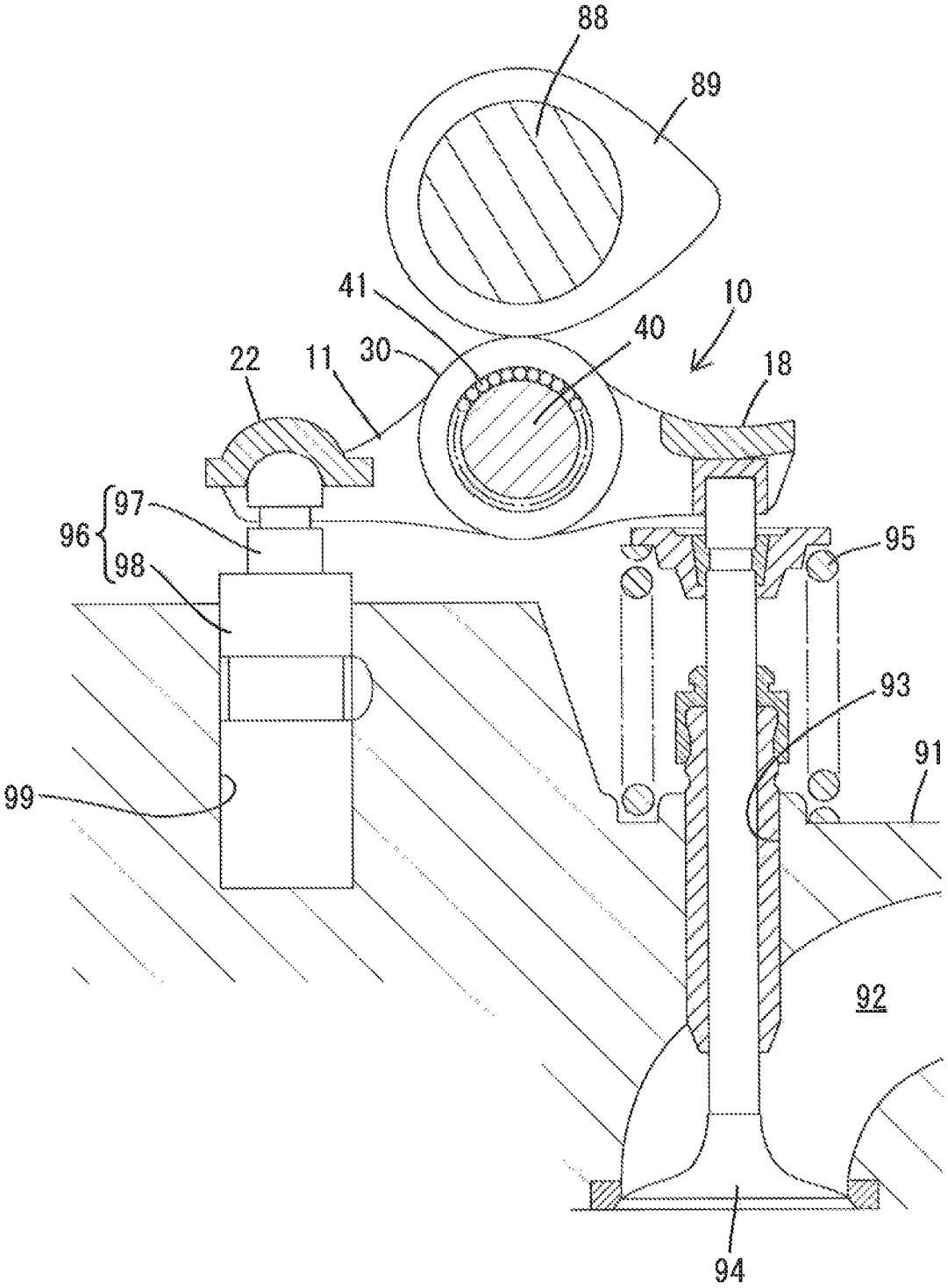
FIG. 6 is a diagrammatic view of a valve gear including the rocker arm.

Referring to FIG. 6, the cylinder head 91 has an air passage 92 (an intake port or an exhaust port) and a stem hole 93 communicating with the air passage 92. A valve 94 (an intake valve or an exhaust valve) is housed in the stem hole 93. The valve 94 is reciprocable between a valve opening position and a valve closing position in an up-down direction as viewed in FIG. 6, which up-down direction serves as a direction in which the stem hole 93 extends. The valve 94 is biased by a valve spring 95 in the valve closing direction (upward as viewed in FIG. 6) to close the air passage 92. The valve 94 has an upper end protruding upward from an opening of the stem hole 93 in an upper surface of the cylinder head 91, abutting against a valve abutting portion 18 of the rocker arm 10, which valve abutting portion 18 will be described later.

The supporting member 96 may be a lash adjuster for example, and has a plunger 97 having an upper end against which a support receiving portion 22 of the rocker arm 10 abuts, and a cylindrical body 98 for housing a plunger 97. The support receiving portion 22 will be described later. The body 98 is inserted into a mounting hole 99 of the cylinder head 91. The plunger 97 is reciprocable in the up-down direction with respect to the body 98 depending on variations in hydraulic pressure. Upon reciprocation of the plunger 97, the valve abutting portion 18 is adjusted so that no clearance is produced between the valve abutting portion 18 and the valve 94.

The rocker arm 10 includes an arm body 11 comprising a metal plate material. The arm body 11 is integrally formed by bending the plate material and comprises a pair of sidewalls 12, a valve side connecting portion 13 and a support side connecting portion 14, as illustrated in FIG. 1.

Figure 1:
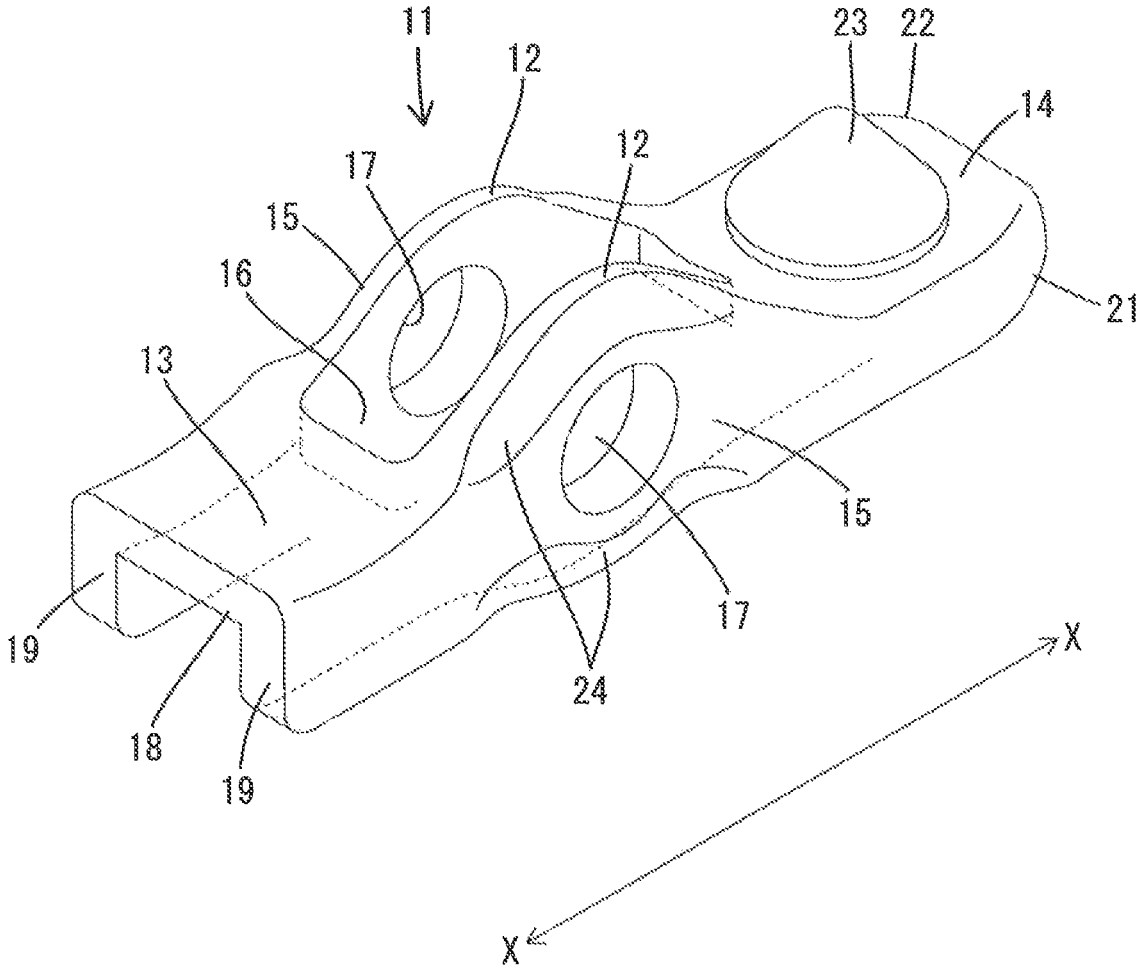
FIG. 1 is a perspective view of an arm body of a rocker arm according to a first embodiment.

The paired sidewalls 12 are disposed substantially in parallel to each other and shaped to extend in an axial direction (in a direction of line X-X in FIG. 1). The sidewalls 12 have respective axial middle portions serving as opposed portions 15 which extend in the heightwise direction (in the up-down direction in FIG. 1) with respect to both axial ends 19 and 21 (adjacent portions). The opposed portions 15 as illustrated in FIG. 1 protrude in the up-down directions from both axial ends 19 and 21 of the sidewalls 12 into an arc shape.

A housing space 16 for housing a roller 30 is defined between both opposed portions 15. The opposed portions 15 have respective central parts through which circular shaft holes 17 are coaxially formed. Furthermore, the opposed portions 15 are formed so as to have substantially constant widths in a radial direction around the shaft holes 17.

A shaft member 40 is mounted to extend through the shaft holes 17 while crossing the housing space 16. The shaft member 40 has two ends swaged thereby to be fixed to the opposed portions 15. Furthermore, the roller 30 is rotatably supported at a middle part of the shaft member 40 via a bearing 41 such as a needle bearing.

The valve side connecting portion 13 is disposed in a width direction of the arm body 11 (a direction in which both sidewalls 12 are opposed to each other) between upper ends of axial ends 19 of both sidewalls 12, thereby defining and closing an axial one end of the housing space 16. The valve abutting portion 18 is formed to have a gate-shaped cross-section by the axial ends 19 of the sidewalls 12 and the valve side connecting portion 13. The valve 94 has a stem upper end which abuts against an underside of the valve side connecting portion 13 and is configured to be guided so as to be prevented from falling-out by the axial ends 19 of the respective sidewalls 12.

The support side connecting portion 14 is disposed between upper ends of the other axial ends of the sidewalls 12 in the width direction of the arm body 11, thereby defining and closing the other axial end of the housing space 16. The support receiving portion 22 is formed to have a gate-shaped cross-section by the other axial ends 21 of the sidewalls 12 and the support side connecting portion 14. The support side connecting portion 14 has a middle part provided with a substantially semi-spherical bulging portion 23 bulging upward. The plunger 97 serving as a supporting member 96 has a top which is slidable on a semispherically recessed underside of the bulging portion 23.

Figure 2:
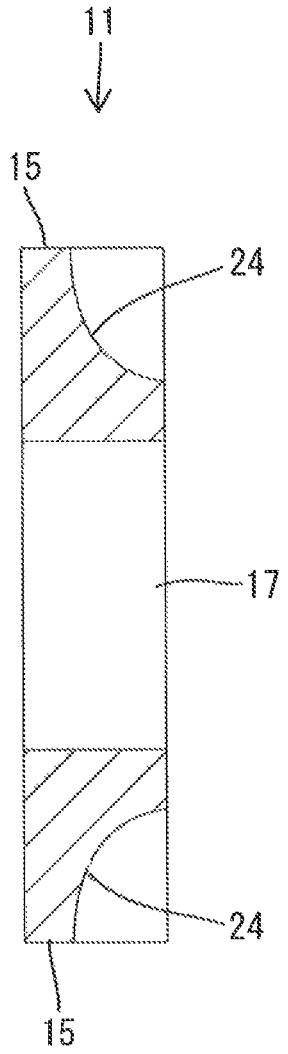
FIG. 2 is a sectional elevation of opposed portions of the arm body.

The opposed portions 15 have upper and lower ends (both heightwise ends) provided with respective thinner portions 24. The thinner portions 24 are formed to be thinner than surrounding portions (a portion near the shaft holes 17 of the opposed portions 15 and both axial ends 19 and 21 of the sidewalls 12). More specifically, the thinner portions 24 extend along the upper and lower ends of the opposed portions 15, and as illustrated in FIG. 2, thinner portions 24 are formed to be recessed from outer side surface to the end surfaces of the opposed portion 15 into concave curved shapes at upper and lower sides with the shaft hole 17 being interposed therebetween. As a result, the thinner portions 24 have thicknesses gradually decreased toward the end surface sides of the opposed portions 15.

Parts of the sidewalls 12 except for the thinner portions 24 are formed so as to have a substantially constant thickness. Furthermore, the sidewalls 12 have inner surfaces formed into wall surfaces continuously rising steeply in the heightwise direction without unevenness inclusive of upper and lower ends which are opposed to the thinner portions 24 in the thickness direction.

Next, the working of the rocker arm 10 will be described with reference to FIG. 6. Upon rotation of the cam 89 mounted on a cam shaft 88, the roller 30 in contact with the cam 89 is driven to be rotated about the shaft member 40, so that the rocker arm 10 is pressed by the cam 89 thereby to be driven downward. The rocker arm 10 is tilted with the top of the plunger 97 serving as a fulcrum in the support receiving portion 22, so that the valve abutting portion 18 pushes the valve 94 downward against the biasing force of the valve spring 95 thereby to turn the valve 94 into an open state. Upon further rotation of the cam 89, the pushing force of the valve abutting portion 18 is reduced, so that the valve 94 is pushed upward by the biasing force of the valve spring 95 thereby to turn the valve 94 into a closed state.

Figure 4:
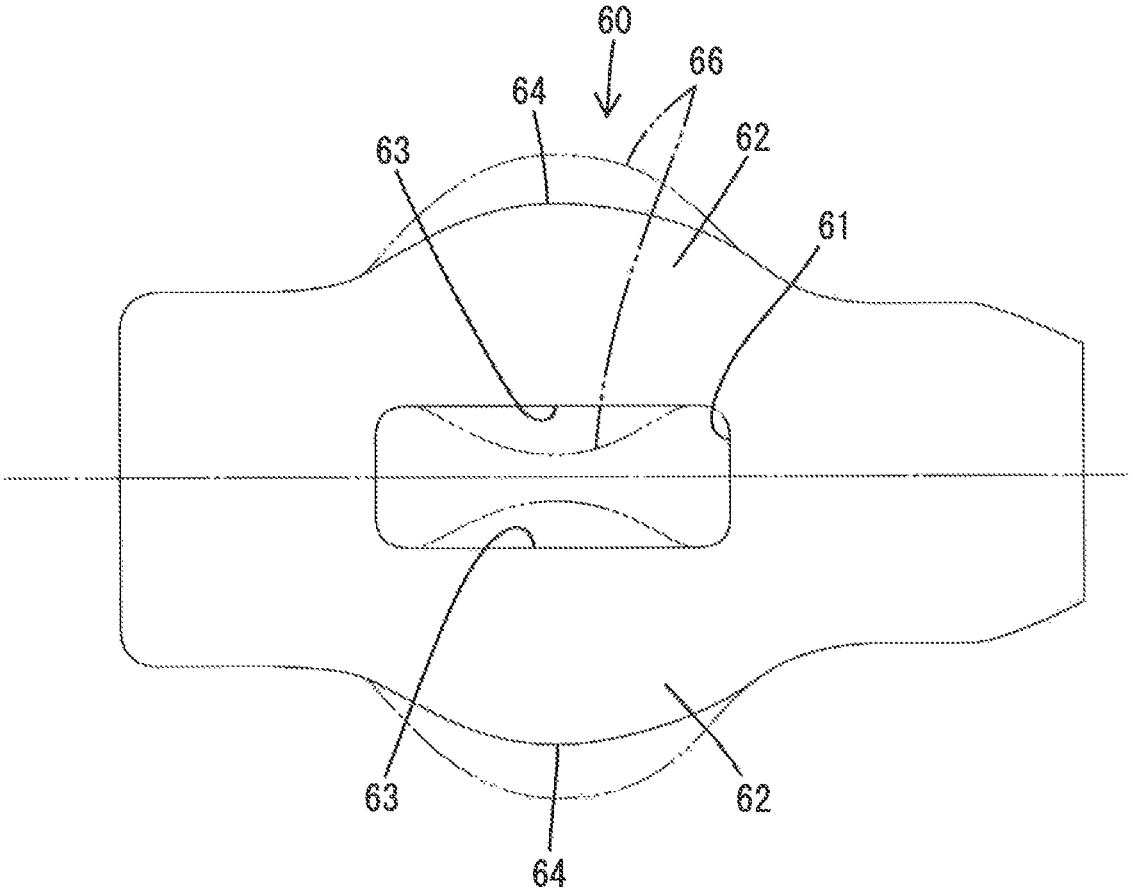
FIG. 4 is a perspective view of a developed body.

A method of manufacturing the rocker arm 10 will now be described. Firstly, a metal plate material is stamped by a punching die (not illustrated) so that a developed body 60 of the rocker arm 10 is formed, as illustrated in FIG. 4. The developed body 60 has a flat plate shape disposed on a common plane. The developed body 60 is symmetrical about a central axis extending along the axial direction (refer to a dot-and-dash line in FIG. 4).

The developed body 60 has a through hole 61 which is formed through a substantially central portion thereof and corresponds to the housing space 16 for the roller 30. The through hole 61 has an opening generally rectangular in shape with rounded corners. The developed body 60 includes two widthwise sides sandwiching the through hole 61 (upper and lower sides as viewed in FIG. 4) where original-shape portions 62 to be formed into opposed portions 15 later are provided alongside. The original-shape portions 62 have straight portions 63 which are parallel to each other and which define both side edges of the through hole 61. The original-shape portions 62 also have gentle arc-shaped portions 64 defining outer edges. The thinner portions 24 to be formed later have inner edges located inward of the straight portions 63 (refer to inwardly bulging portions of the straight portions 63 illustrated by two-dot chain lines in FIG. 4) and outer edges located outside the gentle arc-shaped portions 64 (refer to outwardly bulging portions of the gentle arc-shaped portions 64 illustrated by two-dot chain lines). Accordingly, the original-shaped portions 62 are formed to be smaller in the width direction allowing for the thinner portions 24 to be formed later, so that a bulging amount of each gentle arc-shaped portion 64 can be reduced with the result that the plate material can be saved.

Figure 5:
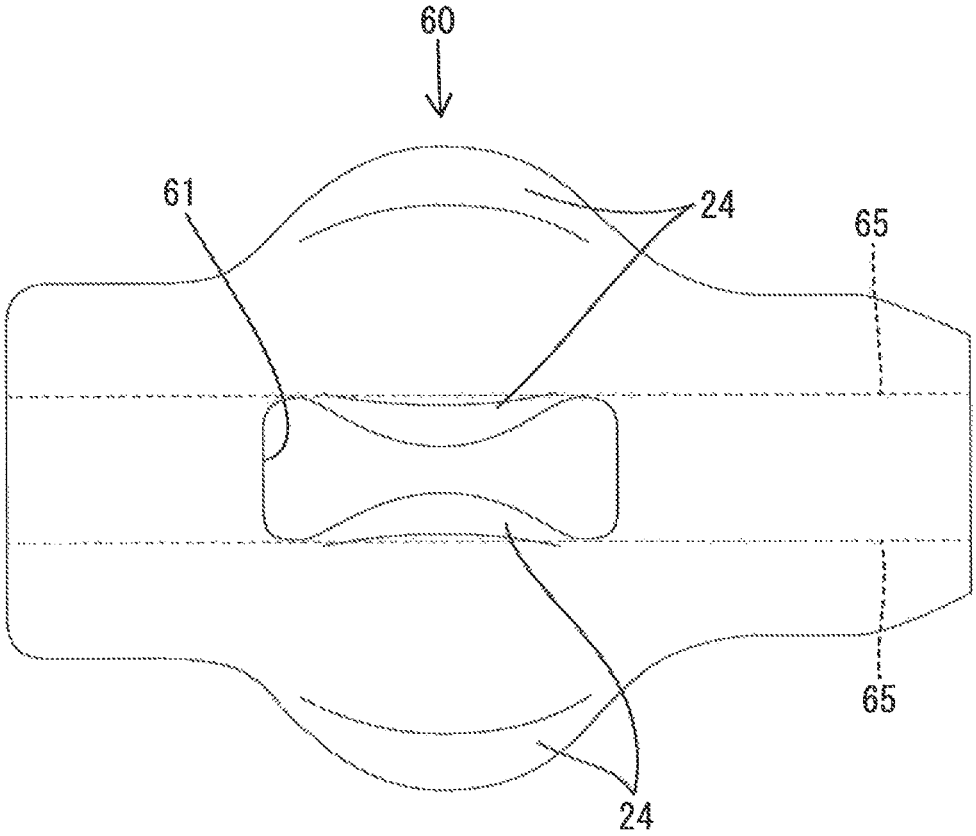
FIG. 5 is a perspective view of the developed body formed with thinner portions having been stretched.

Subsequently, a press die (not illustrated) is pressed against both widthwise ends of each original-shape portion 62 (including the straight portion 63 and the gentle arc-shaped portion 64) from outside. In this pressing process, the inner surfaces of both widthwise ends of the original-shape portions 62 are supported by dies (not illustrated), and outer surfaces of both widthwise ends of the original-shape portions 62 are pressed by dies (not illustrated) thereby to be crushed. As a result, the pair of straight portions 63 are curved to jut out in such a manner that the straight portions 63 come close to each other inward of the through hole 61 thereby to be stretched inward, and the gentle arc-shaped portions 64 are stretched outward so as to depart from the through hole 61. Consequently, both widthwise ends of the respective original-shape portions 62 are deformed so as to be stretched to both widthwise sides (both heightwise sides after forming), whereby the thinner portions 24 are formed as illustrated in FIG. 5. The through hole 61 is constricted inward in shape by the thinner portions 24. Additionally, the upper and lower ends (both heightwise ends) of the opposed portions 15 to be formed in a folding process as will be described later serve as spread regions 66 corresponding to crushing margins of the crushed thinner portions 24 (refer to FIG. 4).

Figure 3:
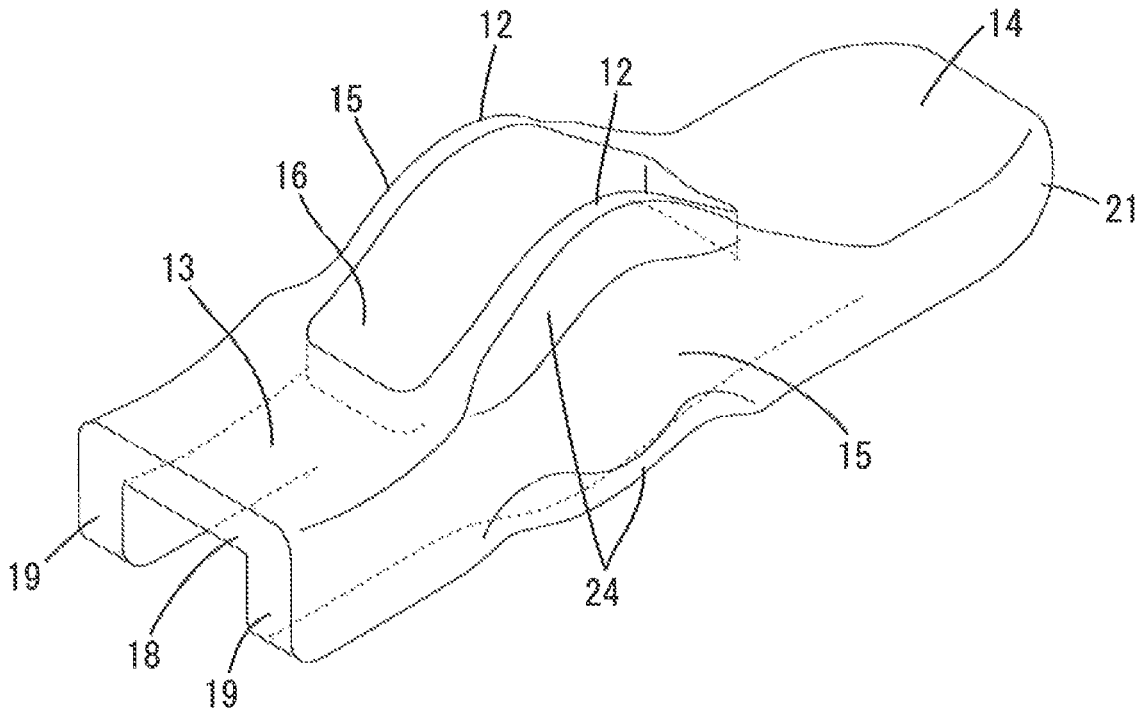
FIG. 3 is a perspective view of the arm body before the forming of a shaft hole.

Next, the developed body 60 is folded via a pair of folding portions 65 which are located at both sides with the through hole 61 being interposed therebetween and are parallel to the axial direction. In this folding process, the developed body 60 is held by a plurality of molding dies (not illustrated), and both sidewalls 12 are formed to be perpendicular to and to be continuous with the valve side connecting portion 13 and the support side connecting portion 14. Furthermore, the housing space 16 for the roller 30 is defined between the valve side connecting portion 13 and the support side connecting portion 14 and between both sidewalls 12, as illustrated in FIG. 3. A direction in which the developed body 60 is folded is specified to the direction in which the thinner portions 24 are located on outer surfaces of the sidewalls 12.

Next, a mold pin (not illustrated) is caused to penetrate through the central parts of the opposed portions 15 of both sidewalls 12 from the widthwise outside, so that the shaft holes 17 are bored. As a result, the arm body 11 is formed. The roller 30 is subsequently disposed in the housing space 16 of the arm body 11. The shaft member 40 is then caused to extend through the roller 30 with the bearing 41 being interposed therebetween, and both ends of the shaft member 40 are inserted through the shaft holes 17 of the opposed portions 15 and then swaged thereby to be fixed.

According to the above-described rocker arm 10 of the first embodiment, since the thinner portions 24 are thinner than the portions of sidewalls 12 adjacent to the respective thinner portions 24, an inertia mass of the arm body 11 can be reduced accordingly, in particular, the thinner portions 24 are thinned utilizing the up-down dimensions of the opposed portions 15, the freedom in the design of the thinner portions 24 can be improved.

Furthermore, since the part of the arm body 11 other than the thinner portions 24 has a usual thickness, the valve abutting portion 18, the support receiving portion 22 and the like can be formed to have respective rigidities enough to withstand the input load.

Furthermore, the shaft member 40 rotatably supporting the roller 30 is held in the shaft holes 17 of the respective opposed portions 15. The thinner portions 24 are formed on the outer surfaces of the opposed portions 15 so as to have shapes such that the thinner portions 24 are recessed. The inner surface of each opposed portion 15 is continuous overall, without unevenness. Accordingly, the bearing 41 such as needle bearing is prevented from being caught by the inner surfaces of the opposed portions 15, with the result that the bearing 41 can be provided without any difficulty.

Furthermore, the thinner portions 24 are provided only on the upper and lower ends (both heightwise ends) of the opposed portions 15. This can reduce influences of the thinner portions 24 on the shaft holes 17 formed in the central parts of the opposed portions 15.

According to the above-described method of manufacturing the rocker arm 10 of the first embodiment, the rocker arm 10 can easily be manufactured from a single plate material by the pressing process. Particularly in the process of forming the thinner portions 24, pressure is applied to the portions of the developed body 60 located at both sides of the through hole 61 so that the portions are stretched. Accordingly, the surface area of the developed body 60 at the time of the punching of the plate material can be rendered smaller by an amount of stretch. As a result, the yield of plate material can be improved. Particularly in the pressure applying process, the paired straight portions 63 are curved to jut out in such a manner that the straight portions 63 come close to each other inward of the through hole 61. Consequently, the space inside the through hole 61 can effectively be used with the result of further improvement of the yield.

Furthermore, since pressure is applied to the developed body 60 so that the thinner portions 24 are formed, the inner tissues of the thinner portions 24 are rendered denser with the result that the strength of the thinner portions 24 can be ensured.

Figure 7:
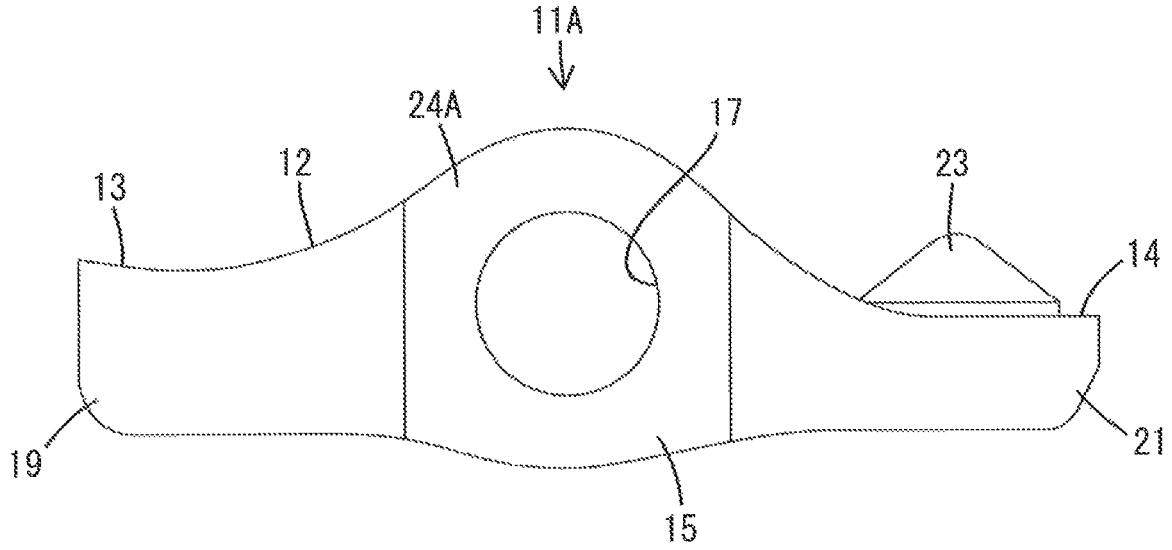
FIG. 7 is a side elevation of the arm body of the rocker arm according to a second embodiment.
Figure 8:
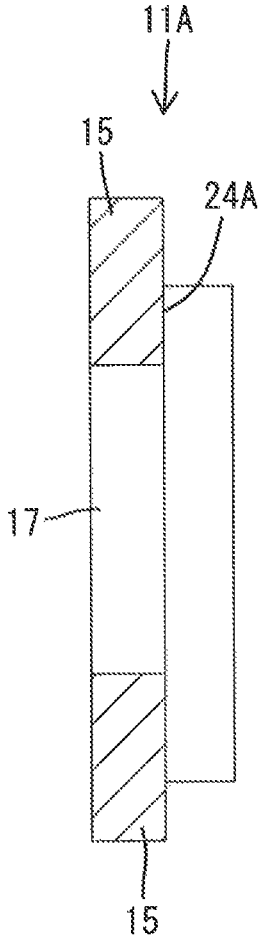
FIG. 8 is a sectional elevation of the opposed portions of the arm body.

FIGS. 7 and 8 illustrate a second embodiment. The second embodiment differs from the first embodiment in forming ranges of the respective thinner portions 24A of the arm body 11A.

The thinner portions 24A are formed on entire outer surfaces of the opposed portions 15 of both sidewalls 12 over entire heights of the opposed portions 15. In manufacture of the thinner portions 24A, entire outer surfaces of parts of the developed body 60 to be formed into the opposed portions 15 later are pressed and stretched by a press die. Accordingly, the opposed portions 15 are rendered thinner in their entirety than both axial ends 19 and 21, so that the outer surfaces of the opposed portions 15 are disposed one level lower than the outer surfaces of both axial ends 19 and 20 of the sidewalls 12. The second embodiment is identical with the first embodiment in the other respect.

According to the second embodiment, the structure of the press die used to form the thinner portions 24A can be simplified, and the thinner portions 24A can be manufactured in a relatively rougher manner.

Figure 9:
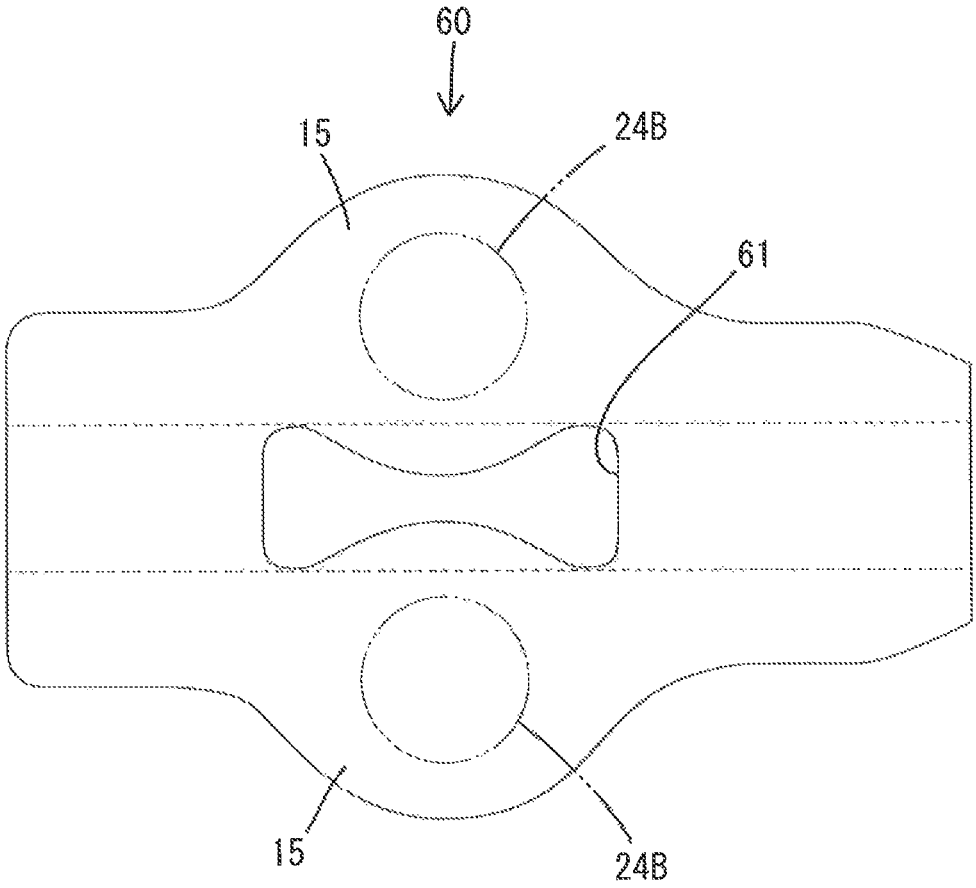
FIG. 9 is a plan view of the developed body formed with the thinner portions having been stretched according to a third embodiment.
Figure 10:
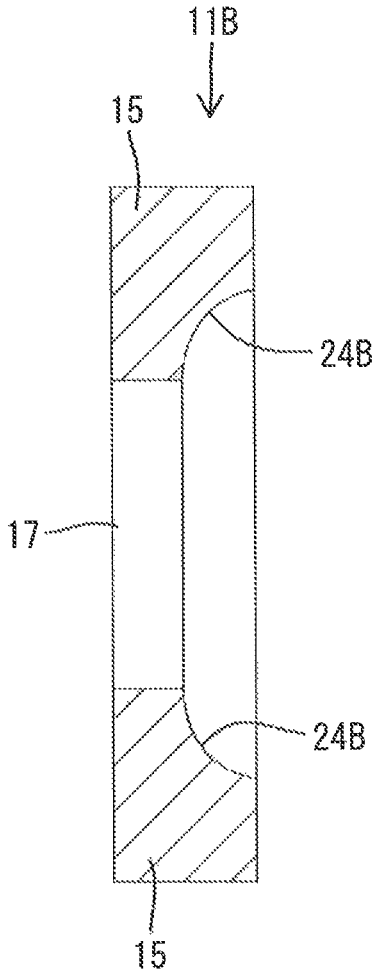
FIG. 10 is a sectional elevation of the opposed portions of the arm body.

FIGS. 9 and 10 illustrate a third embodiment. The third embodiment also differs from the first embodiment in forming ranges of the respective thinner portions 24B of the arm body 11B.

The thinner portions 24B are formed on circumferential edges of the shaft holes 17 in the opposed portions 15 of both sidewalls 12 over entire circumferences of the shaft holes 17. However, no thinner portions 24B are formed on the parts of the opposed portions 15 other than the circumferential edges of the shaft holes 17. As shown in FIG. 10, the thinner portions 24B are formed into such shapes as to be curved and spread outward from the opening edges of the shaft holes 17. In manufacture of the thinner portions 24B, entire outer surfaces of parts of the developed body 60 to be formed into the shaft holes 17 later are pressed and stretched by a press die so that the respective thinner portions 24B are formed (refer to FIG. 9). Subsequently, the mold pin is caused to penetrate through the central parts of the thinner portions 24B, so that the shaft holes 17 are bored. The third embodiment is identical with the first embodiment in the other respect.

According to the third embodiment, since the circumferential edges of the shaft holes 17 of the opposed portion 15 are rendered thinner by the thinner portions 24B, the mold pin used to form the shaft holes 17 can be rendered smaller. This can contribute to reduction in size of the rocker arm 10.

Furthermore, the central parts of the thinner portions 24B are removed from the arm body 11B as the result of the boring of the shaft holes 17 through the centers of the thinner portions 24B. Thus, the forming ranges of the thinner portions 24B remaining in the arm body 11B can be narrowed. Accordingly, reduction in the rigidity of the rocker arm 10 can effectively be suppressed while the improvement of the yield is realized by the stretch of the developed body 60.

Other Embodiments

Other embodiments will briefly be described in the following.

(1) In the first embodiment, the thinner portions may be formed on either upper or lower end of the opposed portions.

(2) In the second embodiment, the thinner portions may not be formed on the entire opposed portions as long as the thinner portions are formed to extend from the openings of the shaft holes to the outer ends of the opposed portions over the entire heights of the opposed portions.

(3) in the third embodiment, the thinner portions may be formed in a part of circumferential edges of the shaft holes of the opposed portions.

(4) In the third embodiment, the entire parts of the developed body to be formed into the shaft holes later may be stretched by the press die thereby to be formed into the thinner portions and subsequently, the entire thinner portions may be removed with the forming of the shaft holes. Since no thinner portions remain on the arm body, the rocker arm can be maintained at the usual rigidity.

(5) The support member supporting the rocker arm should not be limited to the lash adjustor but may be an adjusting bolt or a mere pivot.

(6) The thinner portions may be formed on inner surfaces of the opposed portions.

What is claimed is:

1. A rocker arm comprising:

a pair of sidewalls formed by bending a plate material along a lengthwise direction so as to be opposed to each other, the sidewalls being disposed along a heightwise direction and having respective lengthwise middle portions serving as opposed portions defining a space to house a roller and shaped to protrude in the heightwise direction relative to respective both lengthwise ends of the sidewalls, the opposed portions having respective inner surfaces which are opposed to each other and respective outer surfaces which are located opposite to the inner surfaces and face outward; and a shaft member, wherein:

the opposed portions have thinner portions having smaller thicknesses than the respective both lengthwise ends of the sidewalls;

the opposed portions have respective shaft holes;

the shaft member is held in the shaft holes to rotatably support the roller; and the thinner portions are formed as stepped in regions that are stepped in relative to outer surfaces of both lengthwise ends of the respective sidewalls, and wherein the stepped in regions are provided on an entirety of the outer surfaces of the opposed portions inclusive of circumferential edges of the shaft holes and over an entire height of the opposed portions.

2. The rocker arm according to claim 1, wherein the plate material forming the side walls is a metal plate material.

3. A rocker arm comprising:

a pair of sidewalls formed by bending a plate material along a lengthwise direction so as to be opposed to each other, the sidewalls being disposed along a heightwise direction and having respective lengthwise middle portions serving as opposed portions defining a space to house a roller and shaped to protrude in the heightwise direction relative to respective both lengthwise ends of the sidewalls; and a shaft member, wherein:

the opposed portions have thinner portions having smaller thicknesses than the respective both lengthwise ends of the sidewall;

the opposed portions have respective shaft holes;

the shaft member is held in the shaft holes to rotatably support the roller;

the thinner portions are formed on both heightwise ends of the opposed portions;

the sidewalls have thicker portions which are thicker than the thinner portions in regions extending over the respective both lengthwise ends of the sidewalls and heightwise middle portions of the opposed portions; and the shaft holes are provided so as to penetrate the thicker portions.

4. A method of manufacturing a rocker arm according to claim 3, comprising:

stamping the plate material to form a developed body having a through hole;

applying pressure to parts of the developed body located at both sides of the through hole to stretch the parts of the developed body, thereby forming the thinner portions; and folding the developed body via a pair of folding portions parallel to each other thereby to raise portions with the thinner portions in the heightwise direction, so that the pair of sidewalls are formed which are opposed to each other with the space for housing the roller being interposed therebetween.

5. The method according to claim 4, further comprising forming the shaft holes through the respective sidewalls to mount the shaft member rotatably supporting the roller in the shaft holes.

6. The method according to claim 4, wherein the through hole of the developed body has two side edges, the two side edges being a pair of straight portions parallel to each other before the forming of the thinner portions, and wherein in the forming of the thinner portions, the pair of straight portions are deformed to be curved to jut out in such a manner as to come close to each other inward of the through hole.

7. The rocker arm according to claim 3, wherein the thinner portions that are formed on both heightwise ends of the opposed portions are concave surfaces that have lengthwise outer regions that are thinner in heightwise thickness than a middle region of the concave surfaces located between the lengthwise outer regions.

8. The rocker arm according to claim 3, wherein the plate material forming the side walls is a metal plate material.

9. A rocker arm comprising:

a pair of sidewalls formed by bending a plate material along a lengthwise direction so as to be opposed to each other, the sidewalls being disposed along a heightwise direction and having respective lengthwise middle portions serving as opposed portions defining a space to house a roller and shaped to protrude in the heightwise direction relative to respective both lengthwise ends of the sidewalls; and a shaft member, wherein:

the opposed portions have thinner portions having smaller thicknesses than the respective both lengthwise ends of the sidewalls;

the opposed portions have respective outer surfaces provided with pressed recesses formed by pressing, the pressed recesses respectively having central bottoms through which shaft holes are bored;

the shaft member is held in the shaft holes to rotatably support the roller;

the thinner portions are respectively formed on circumferential edges of the shaft holes in the pressed recesses so as to be curved and spread radially outward of the shaft holes; and entire inner surfaces of the opposed portions are flat surfaces bordering the shaft holes and extending radially out both along the heightwise direction and the lengthwise direction of the sidewalls.

10. The rocker arm according to claim 9 wherein plate material forming the side walls is a metal plate material.

* * * * *